US006825826B1

(12) United States Patent
Mikami et al.

(10) Patent No.: US 6,825,826 B1
(45) Date of Patent: Nov. 30, 2004

(54) LIQUID CRYSTAL DISPLAY APPARATUS

(75) Inventors: Yoshiro Mikami, Hitachiota (JP); Hideo Sato, Hitachi (JP); Hiroshi Kageyama, Hitachi (JP); Kazuhito Masuda, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/511,160

(22) Filed: Feb. 23, 2000

(30) Foreign Application Priority Data

Feb. 26, 1999 (JP) ..... 11-049619

(51) Int. Cl.[7] ..... G09G 3/36

(52) U.S. Cl. ..... 345/98; 345/87; 345/90; 345/92; 345/93; 345/100; 345/204; 345/205; 345/206

(58) Field of Search ..... 345/98, 100, 87, 345/90, 92, 93, 204, 205, 206

(56) References Cited

U.S. PATENT DOCUMENTS 6,222,518 B1 * 4/2001 Ikeda et al. ..... 345/98
6,268,841 B1 * 7/2001 Cairns et al. ..... 345/98

* cited by examiner

*Primary Examiner*—Xiao Wu
*Assistant Examiner*—Jean Lesperance
(74) *Attorney, Agent, or Firm*—Antonelli, Terry, Stout & Kraus, LLP

(57) ABSTRACT

A liquid crystal display apparatus includes: one of a pair of substrates being transparent and a liquid crystal layer sandwiched between the pair of substrates; the one substrate including a plurality of scanning wirings, a plurality of signal wirings, a plurality of thin film semiconductor devices formed on intersections of the scanning wirings and the signal wirings, and a display electrode; and the other substrate including an opposed electrode. The apparatus further includes: first relay buses extended continuously over a width of said signal wirings, and second relay buses divided the width of signal wirings into a plurality of blocks; a relay circuit formed between the first and second relay buses for each of the blocks; a data latch read the display data in sequence through the second relay buses to latch the display data of one block amount; a memory circuit which reads out the display data of the one block amount simultaneously; a level shifter circuit which reads out a content of the memory circuit to change a logical voltage; and a D/A circuit which converts an output from the level shifter circuit into an analog voltage to drive the signal wirings.

9 Claims, 9 Drawing Sheets

LIQUID CRYSTAL DISPLAY APPARATUS

BACKGROUND OF THE INVENTION

1. Field of the Invention

The present invention relates to a liquid crystal display apparatus, and more particularly to a liquid crystal display apparatus with a built-in peripheral circuit in which driving units and a display unit are formed on a substrate.

2. Description of the Related Art

As a driving system for driving a small-sized and high-resolution liquid crystal display panel, there has been employed a method of using thin film transistors to form a matrix peripheral circuit on a glass substrate. This method has been reported in, for example, "SID International Symposium Digest of Technical Papers", pp. 879–882, 1998. Also, concerning the details of the active matrix driving system and the liquid crystal display module, the detailed explanation is given in Syouichi Matumoto as editor and writer, entitled "Liquid Crystal Display Technology" (Sangyo Tosho).

Hereinafter, the explanation will be given below concerning the configuration of a liquid crystal display apparatus illustrated in FIG. 2 and the schematic configuration of a liquid crystal display apparatus according to the present invention illustrated in FIG. 1. This is intended in order to clarify the difference between the related art and the present invention.

In FIG. 1, display image data and synchronization signals are supplied from input terminals 214 of a liquid crystal display module 105 to a digital data driver unit 106 through high-speed data buses 203 and high-speed control buses 216. In the digital data driver unit, low-speed data buses 102 and low-speed control buses 107 are arranged in such a manner that they are separated for each of a plurality of blocks 103. The display image data on the low-speed data buses are present in parallel and are then transferred to data latches by the low-speed data buses at a transfer rate lower than that of the high-speed data buses. Here, the parallel distribution is executed by high-speed data rearranging circuits 101 located for the respective blocks. Also, synchronization signals necessary for shift registers and the data transfer are generated individually for each block by high-speed data control circuits 104 arranged on each block. The distributing operations of the display data into the data latches are thereby performed with timings that are independent for the respective blocks.

In the configuration of the TFT liquid crystal display module illustrated in FIG. 2, there are included none of the low-speed data buses that transfer the display data at the lower rate. Instead, one set of high-speed data buses 203, which have been inputted into a liquid crystal display module 215 from input terminals 214, and high-speed control buses 216 drive shift registers 202, thereby transferring the display image data to the respective data latches 204. After that, the display data by the amount of one line on the data latches are latched into line memories 205. Then, the digital display data, after being amplified in the voltage by level shifters 206, are converted into a liquid crystal driving voltage by D/A converting circuits 207 provided for each signal line. The liquid crystal driving voltage then drives a pixel unit 209 through signal line 208. A scan drive circuit 213, which includes a shift register 211 connected to each other in series and a level shifter 212 outputs a scan line select pulse for the pixel unit to scan lines 210, thereby accomplishing the active matrix display. In this system, as the display panel grows large-sized and obtains a higher resolution, it becomes required to increase the wiring width in order to suppress signal delays occurring in the data buses. This has become a cause of increasing an area of the wiring unit.

Also, it is required to drive the data latches and the line memories in the data driver circuit on condition that all of them are in synchronization with each other. On account of this, if differences in time increase among the synchronization signals toward the respective units of the circuit, it becomes impossible to synchronize the respective units of the circuit. This situation has made it difficult to implement the peripheral circuit on the large-sized display panel with the use of the TFTs of comparatively drivability.

Also, since a number of data latches are connected to one set of the data buses, the capacitance value of a data bus wiring becomes larger. On account of this, a time constant determined by the wiring resistance and the wiring capacitance increases, eventually prolonging the wiring delay time. This condition has also made it difficult to implement the peripheral circuit on the large-sized display panel.

As described above, toward the liquid crystal display module for each horizontal scanning time-period, it is required to transfer, through the data buses within the panel, the pixel display data by the amount of one scanning line to the respective data latches corresponding to the signal wirings of the pixel unit. The data transfer rate at this time is increased as the number of the pixels becomes larger. For example, in the configuration of 1024×768 pixels, it is necessary to achieve a high-speed data transfer in which 18-bit data for each pixel are transferred with a frequency of about 50 MHz.

In order to execute such a high-speed data transfer, the display data of one field are rearranged for each pixel in series one after another, then being supplied through the data buses connected to all the data latches. After that, the data are transferred by operating a specified data latch in accordance with a start pulse, a transfer clock signal, and data latch signals, that are shifted in sequence using the shift register circuits. However, the data buses necessitate a length of the display region in the horizontal direction, and have a long wiring length. What is more, the large numbers of data latches accompanied by the capacitance load are connected to a single wiring. Thus, the load capacitance of the wiring is built up with the number of the pixels in the panel, thereby increasing the wiring delay. Namely, increasing the number of the pixels requires the data transmission at an even higher transfer rate; nevertheless, the wiring resistance and the wiring load capacitance also increase and thus the wiring delay is prolonged as well. Consequently, in the above-described configuration, it was difficult to upsize the high-resolution display panel.

SUMMARY OF THE INVENTION

It is an object of the present invention to provide a liquid crystal display apparatus that has only a small load capacitance on the display panel and that, even in the large-sized high-resolution panel, permits the display data inputted into the high-speed data buses to be transmitted up to terminal ends of the data buses with a small waveform distortion.

In order to accomplish the above-described object of the present invention, a display region using the TFT (thin film transistors) active matrix system and a peripheral circuit using the TFTs are formed on a substrate of the liquid crystal display panel of the liquid crystal display apparatus. Moreover, there are provided high-speed buses which include high-speed data buses and high-speed control buses, and low-speed data buses divided into the blocks, and a signal wiring driving circuit. The high-speed buses supply high-speed display data from the outside. A waveform shaping circuit provided in the course of bus wirings corrects the waveform distortion due to the signal delay in the bus wirings. In addition, the high-speed buses transfer to terminal ends the high-speed display data and high-speed control signals such as dot clock and synchronization signals.

The display data are distributed in parallel onto the large numbers of low-speed data buses for each block, then being transferred in sequence to the respective data latches. After that, the digital display data are converted into the liquid crystal driving voltage by respective line memories and respective D/A converting circuits so as to drive an active matrix display unit.

Also, the low-speed data buses are divided into the blocks and are caused to operate by individual timing signals. This makes it possible to fetch the display data, which have been distributed in parallel onto the large numbers of low-speed data buses, into the large numbers of data latches in sequence at a low data transfer rate. Furthermore, even if a tremendous signal delay occurs between the blocks on the high-speed data transfer buses, it is possible to correctly transfer the display data to the respective latches because the sampling operations toward the latches are independent for the respective blocks. The above-described effects permit the display data to be transferred to the respective data latches even if the display data transfer rate is increased in the high-resolution large-sized panel. Consequently, it is possible to speed up, as a whole, the data transfer rate even in the case of the large-sized panel.

A feature of the configuration according to the present invention lies in a point of providing the low-speed data buses that are independent for each block, so that the synchronization controls are made independent for each block.

First, the display image data is input to the liquid crystal display module, and supplied on the high-speed data buses. The display image data that the high-speed data control circuits cause to correspond to each block are rearranged in parallel by the high-speed data rearranging circuits onto the low-speed data buses, the number of which is larger than that of the high-speed data buses. The data latch circuits connected to the high-speed data buses are at the capacitance load. Accordingly, if this capacitance load is built up, the wiring delay increases, thus making it difficult to speed up the data transfer. The large numbers of data latch circuits that are equivalent to the number of the signal lines have been connected to the high-speed data buses. In the configuration according to the present invention, however, a single data latch circuit is connected to the high-speed data buses for each block. Furthermore, while data in no correspondence with a block is being transferred, the low-speed data buses can be cut off from the high-speed data buses. This makes it possible to exceedingly reduce the capacitance load of the data bus wiring. Similarly, regarding the high-speed control buses as well, the large numbers of shift registers have been connected to the high-speed control buses in the configuration. In the present invention, however, only a single high-speed data control circuit is connected to the high-speed control buses for each block. This makes it possible to reduce the capacitance load. In this way, it is possible to drive the high-speed buses with a low capacitance load. This condition permits the high-speed data bus wirings to be implemented using a fine wiring, thereby bringing about an advantage of making the circuit area smaller.

Next, the present invention exhibits a feature that the data is transferred from the low-speed data buses to the data latches in accordance with the individual synchronization signal for each block. In the related art, all the shift registers and the data latches of an entire display panel have been driven in accordance with a high-speed synchronization signal such as a dot clock on a wiring that is common to the shift registers and the data latches. On account of this, if the waveform is distorted due to causes such as the wiring delay or there exists a significant shift in the phase between the data and the synchronization signal, it becomes impossible to perform the data latch operation over the entire data driver circuit. This situation, accordingly, has become a bottleneck in embodying the large-sized and high-resolution display panel. Meanwhile, according to the present invention, the synchronization signals necessary for the data latch operation are generated independently for each block. Consequently, even if a delay occurs on the high-speed data buses, the synchronization has been achieved within each block, thus allowing a secure data latch operation even in the case of the large-sized and high-resolution panel. Since the data transfer speed within a block is low, the data buses within each block are of the low-speed data buses. Thus, a time for the data latch operation can be prolonged as compared with the conventional configuration. This results in an advantage of allowing the data latch to be performed more securely. Owing to this, even if the transmission delay occurs to some extent in the high-speed control buses or the high-speed data buses, it is possible to perform the data latch operation. Consequently, it becomes possible to correct the waveform distortion during the wiring transmission by providing a waveform shaping circuit in the course of the high-speed data bus wirings, thereby allowing the data transfer even when a wiring length is long. This also results in an advantage of allowing the large-sized panel to be implemented easily.

Also, the data driver circuit is divided into the blocks so that the data latch operation and the D/A conversion operation can be executed individually. This condition averages the power to be consumed in the circuits in these blocks, thereby making it possible to lessen width of the power supply wiring. Accordingly, it becomes possible not only to lessen the area of the data driver circuit but also to lessen a peak output of a power supply circuit for driving the data driver circuit. This reduces the load of a power supply circuit, thus bringing about an advantage of allowing the large-sized panel to be driven easily.

DESCRIPTION OF THE EMBODIMENTS

Hereinafter, embodiments of the present invention will be described with reference to the drawings in relation to the liquid crystal display apparatus.

Figure 1:
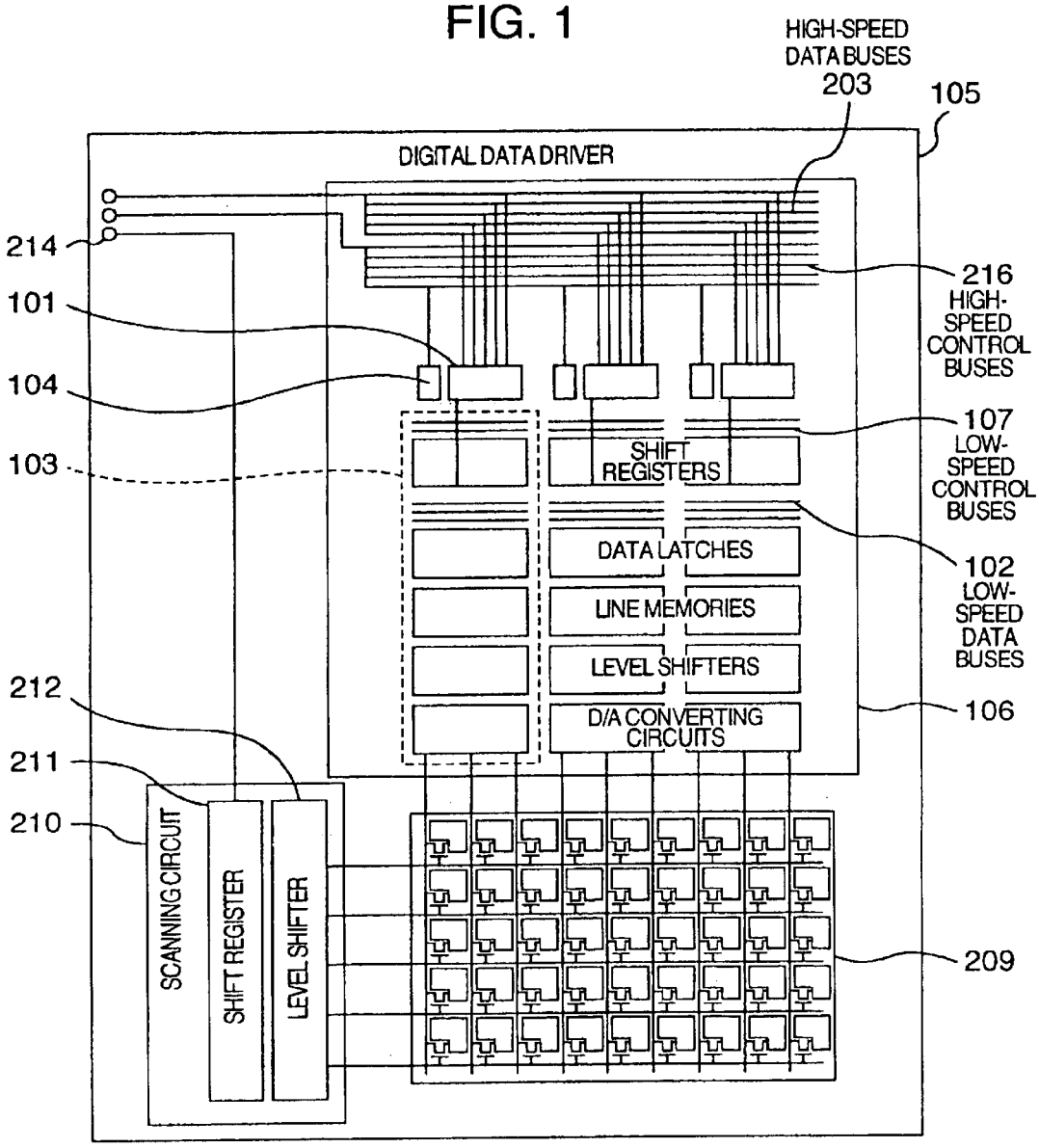
FIG. 1 is the schematic configuration of the display apparatus according to the present invention.
Figure 2:
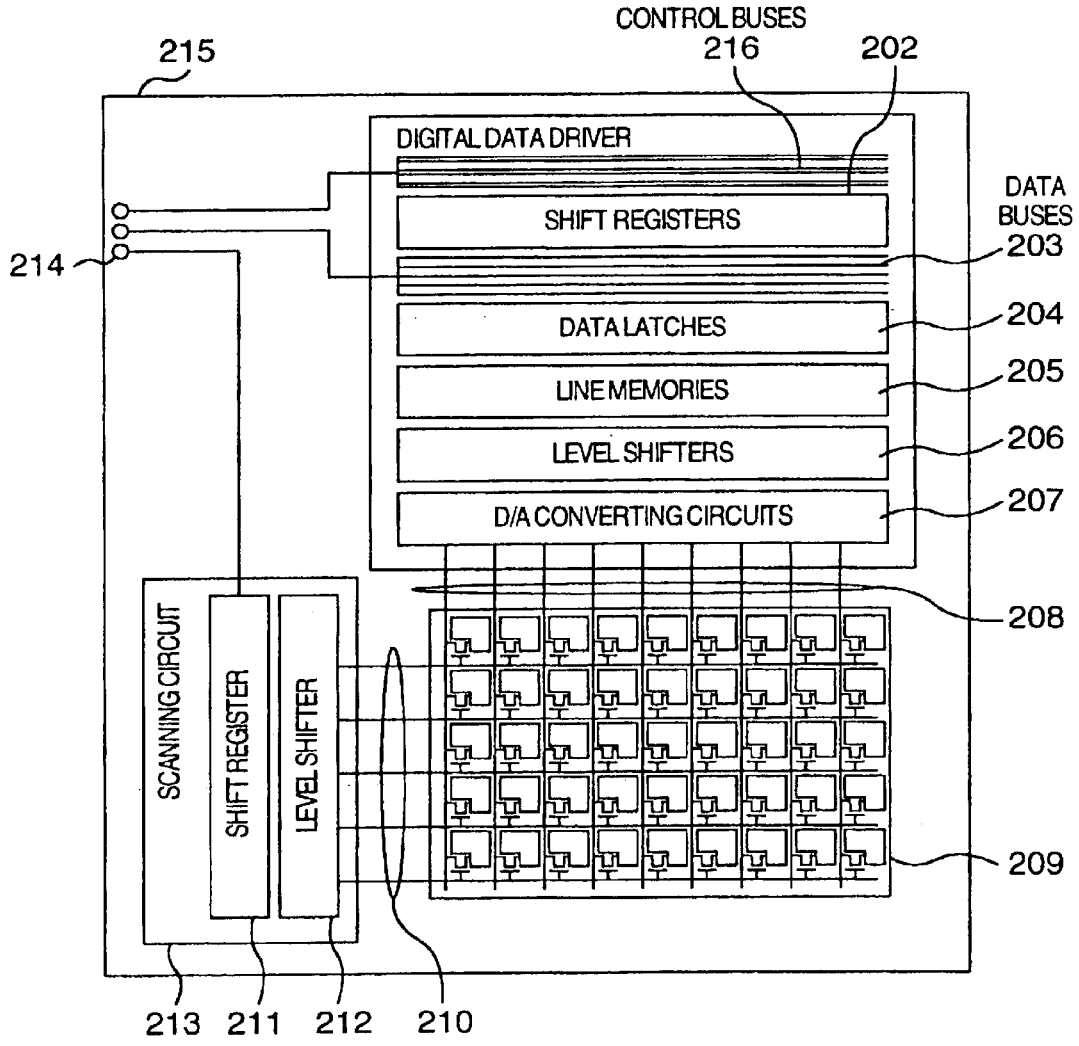
FIG. 2 is the schematic configuration of the display apparatus according to the related art.
Figure 3:
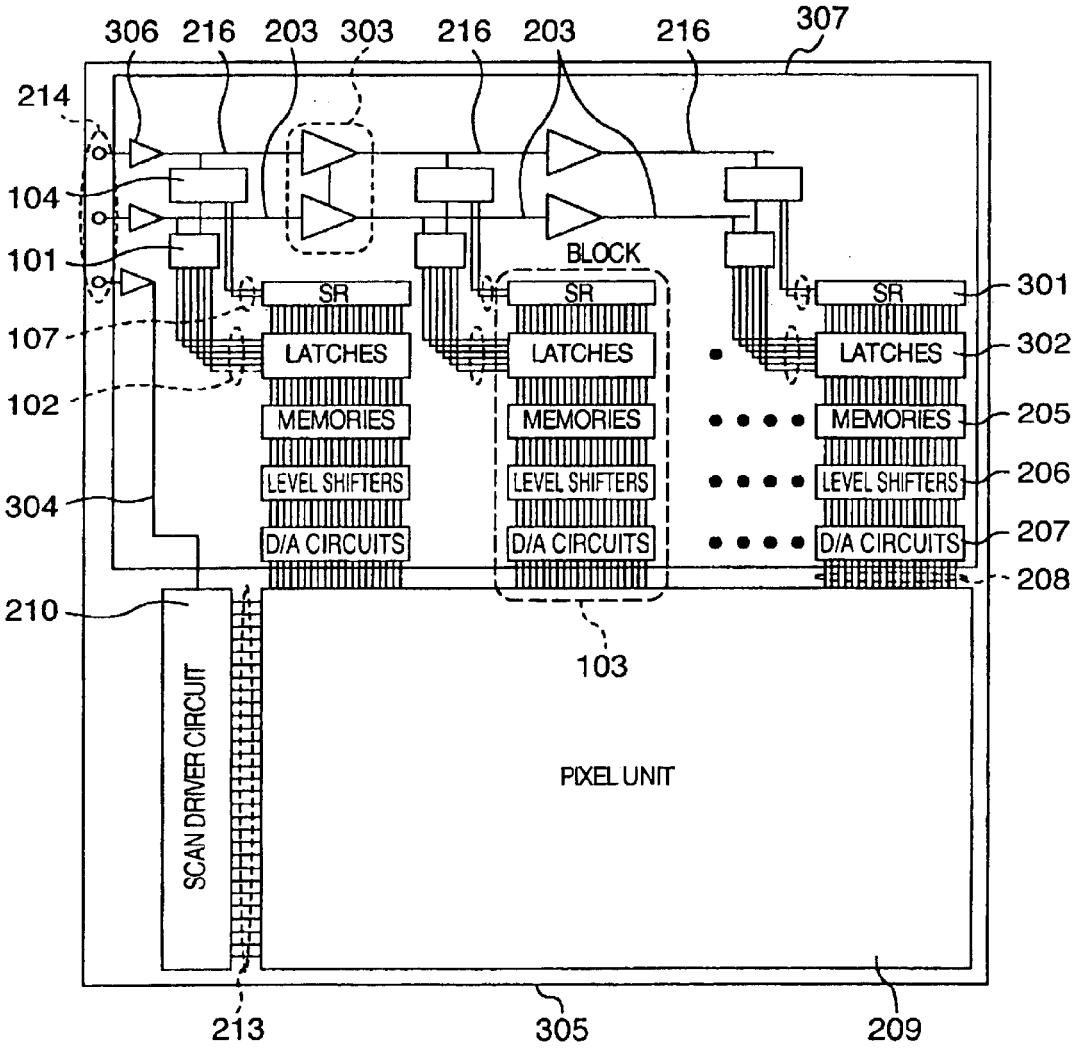
FIG. 3 is a circuit block configuration diagram of the liquid crystal display apparatus according to the present invention.

FIG. 3 illustrates a circuit configuration of a first embodiment of the liquid crystal display apparatus. The circuit includes, a data driver circuit 307 including a high-speed data bus 203 and low-speed data buses 102 divided into blocks, a scan driver circuit 210, and a pixel unit 209 including active matrix pixels constituted by thin film transistors. These circuits are formed by the CMOSTET fabricating process on a glass substrate 305 of the display apparatus.

A substrate on which the above-mentioned circuits are formed can be fabricated by using the following processes.

A non-alkaline glass is employed as a glass substrate. The substrate is realized by a low temperature poly-Si TFT fabricating process which includes a process of polycrystallizing an Si film constituting CMOS FETs by using laser-anneal crystallization and a doping process of obtaining n-type Si and p-type Si.

A quartz substrate may be employed. The substrate may be realized by a high-temperature poly-Si process in which a poly-Si film is formed by using solid phase crystallization.

Next, the explanation will be given below regarding the details of the configuration illustrated in FIG. 3.

Display data and synchronization signals necessary for the display from input terminals 214 are supplied to high-speed bus driving circuits 306. The high-speed bus driving circuits 306 are connected to the high-speed data bus 203 and a high-speed control bus 216. The high-speed data bus 203 and the high-speed control bus 216 are connected in sequence to high-speed data control circuits 104 and high-speed data rearranging circuits 101, which are arranged on each block 103, through the waveform shaping circuits 303 on the way to the data rearranging circuits. The display data are distributed in parallel onto the low-speed data buses 102 divided for the respective large numbers of blocks, then being connected to the respective latch circuits 302 in each block. Here, the data rearranging circuits 101 expand the data in parallel in accordance with synchronization signals from the high-speed data control circuits 104. Also, the synchronization signals within the blocks are generated by the high-speed data control circuits 104 from the synchronization signals on the high-speed control bus 216, then being supplied to the blocks by low-speed control buses 107 divided for the respective blocks. Within each block, in correspondence with signal lines 208 of the pixel unit 209, there are provided a plurality of shift registers 301, the plurality of data latch circuits 302, a plurality of line memories 205, a plurality of level shifters 206, and a plurality of D/A converting circuits 207. Also, based on a synchronization signal supplied by a panel scanning control bus 304, the scan driver circuit 210 generates a scanning pulse needed for a line sequence scanning of the pixel unit 209, then supplying the scanning pulse to scanning lines 213 of the pixel unit.

Based on the above-described configuration, the present circuit performs the display operation in the following manner:

A dot clock, horizontal synchronization and vertical synchronization signals and the display data undergo a low impedance transformation and a level shift processing performed by the high-speed bus driving circuits 306. After that, they are supplied to the high-speed data bus 203 and the high-speed control bus 216, then being supplied to the respective blocks. Here, the level shift processing adjusts amplitudes of the logical signals so that they may be fitted to the logical circuits including the CMOSTFTs. Also, the waveform shaping circuits 303 located on the way correct a waveform distortion and a shift in timing between the data and the synchronization signals occurring during the bus transmission.

In connection with the respective blocks, from the dot clock and the horizontal synchronization signal on the high-speed control bus, the corresponding high-speed data control circuit 104 detects a time-period during which the data needed for the processing in the corresponding block has been reaching, then connecting the corresponding data rearranging circuit 101 to the high-speed data bus. In accordance with a control signal from the high-speed data control circuit 104, the data rearranging circuit 101 executes an operation of rearranging in parallel the data on the high-speed data bus onto the low-speed data buses 102. Here, the wiring number of the low-speed data bus is constituted to be larger than at least the wiring number of the high-speed data bus. The shift registers 301, which operate in synchronization with the parallel rearranging operation, cause the latch circuits 302 to generate data latch signals in sequence. Then, the latch circuits 302 latch the display data on the low-speed data buses 102, thereby transferring, to the latch circuits 302, the display data corresponding to the corresponding block 103. The respective blocks perform the above-described operation in sequence. When the display data by the amount of one line are transferred to all the latch circuits, the latch circuits transfer the data to the line memories 205. Then, the display data, after being converted into a liquid crystal driving voltage by the D/A converting circuits, drive the signal wirings 208 so as to drive the pixel unit 209.

Also, following through the panel scanning control bus 304 a frame start signal inputted from the input terminals 214, the scan driver circuit 210 drives the scanning wirings 213 of the pixel unit 209, thereby making it possible to perform the display operation.

In this configuration, the larger the number of wirings of the low-speed data bus is, the more likely it is to be able to lessen the number of the blocks, to be able to reduce the load onto the high-speed data bus and to be able to lengthen the wirings. On the other hand, increasing the number of wirings of the low-speed data bus results in an increase in the occupation area of the wirings and thus an increase in the circuit area. This situation requires that the number of wirings be optimized.

The explanation will be given regarding the case of an actual panel. In a panel with 640×480 pixels, when transferring 640 pixels by the amount of one line and a 6-bit gray shade signal for each of R, G and B colors, it is required to transfer 640×3×6=11520 bits. Conventionally, the shift register circuit has been driven with a frequency of 25 MHz, and 640 units of the latch circuits have been connected to each of the high-speed data line installed inside a 4.7-inch diagonal panel.

In contrast to this, in the present invention, only the high-speed data rearranging circuits that are equal to the blocks in number are connected to the high-speed data bus. For example, if the number of the blocks is 8, octal data latches are connected per data line, and it is possible to reduce, down to 1/80th, the number of the load circuits to be connected to the high-speed data bus. Accordingly, when comparing the wiring time constants under the same condition, 1/80th of the wiring width turns out to be sufficient. This makes it possible to reduce the area of the wiring portion.

Hereinafter, the explanation will be given concerning the detailed configuration of the circuit portion in each block, using the case where the number of the pixels is 1024×768 and the number of the blocks is 8. It is needless to say that the present system can also be implemented in the other pixel configurations.

Figure 4:
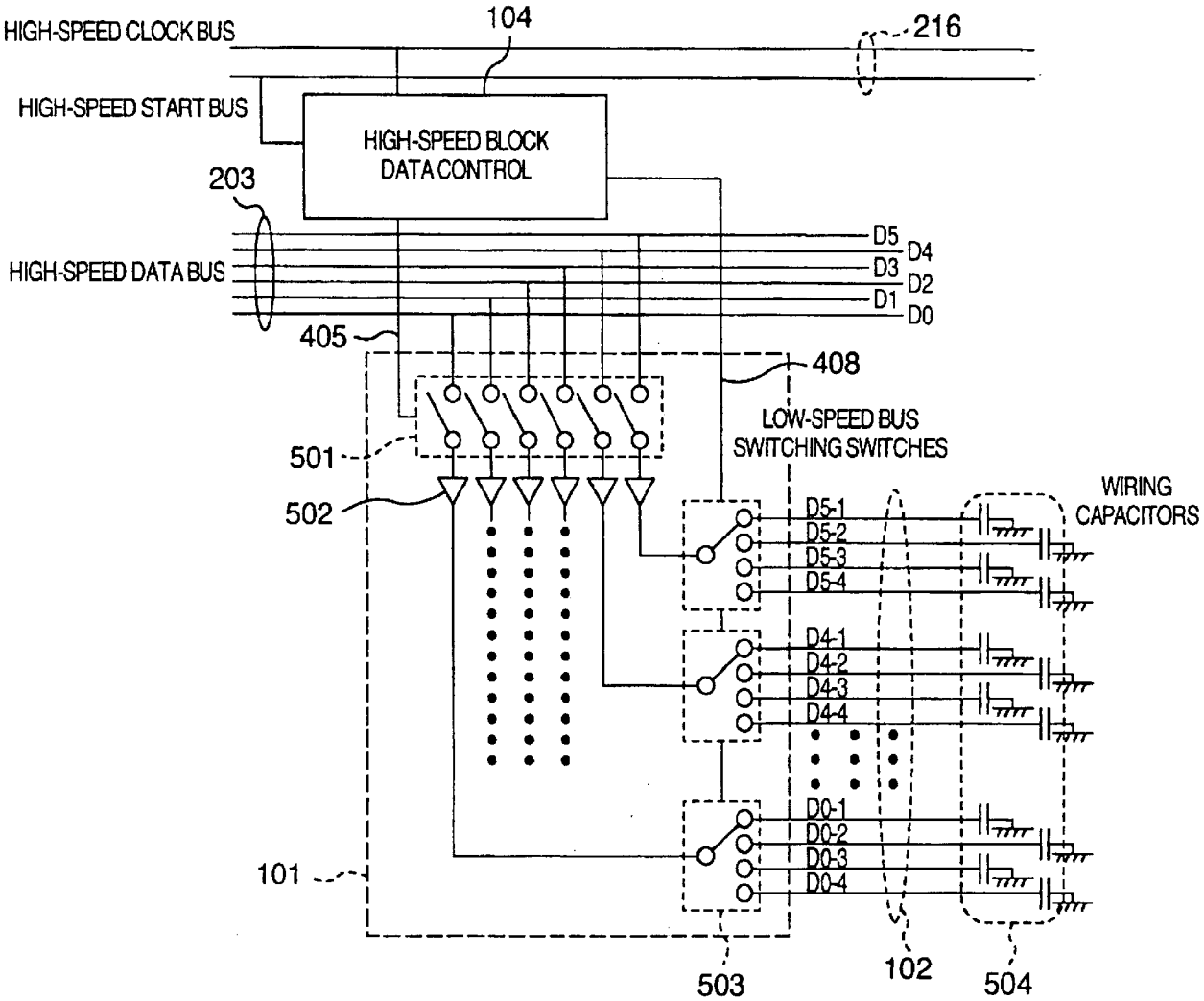
FIG. 4 is a detailed configuration diagram of the high-speed data control circuit.
Figure 5:
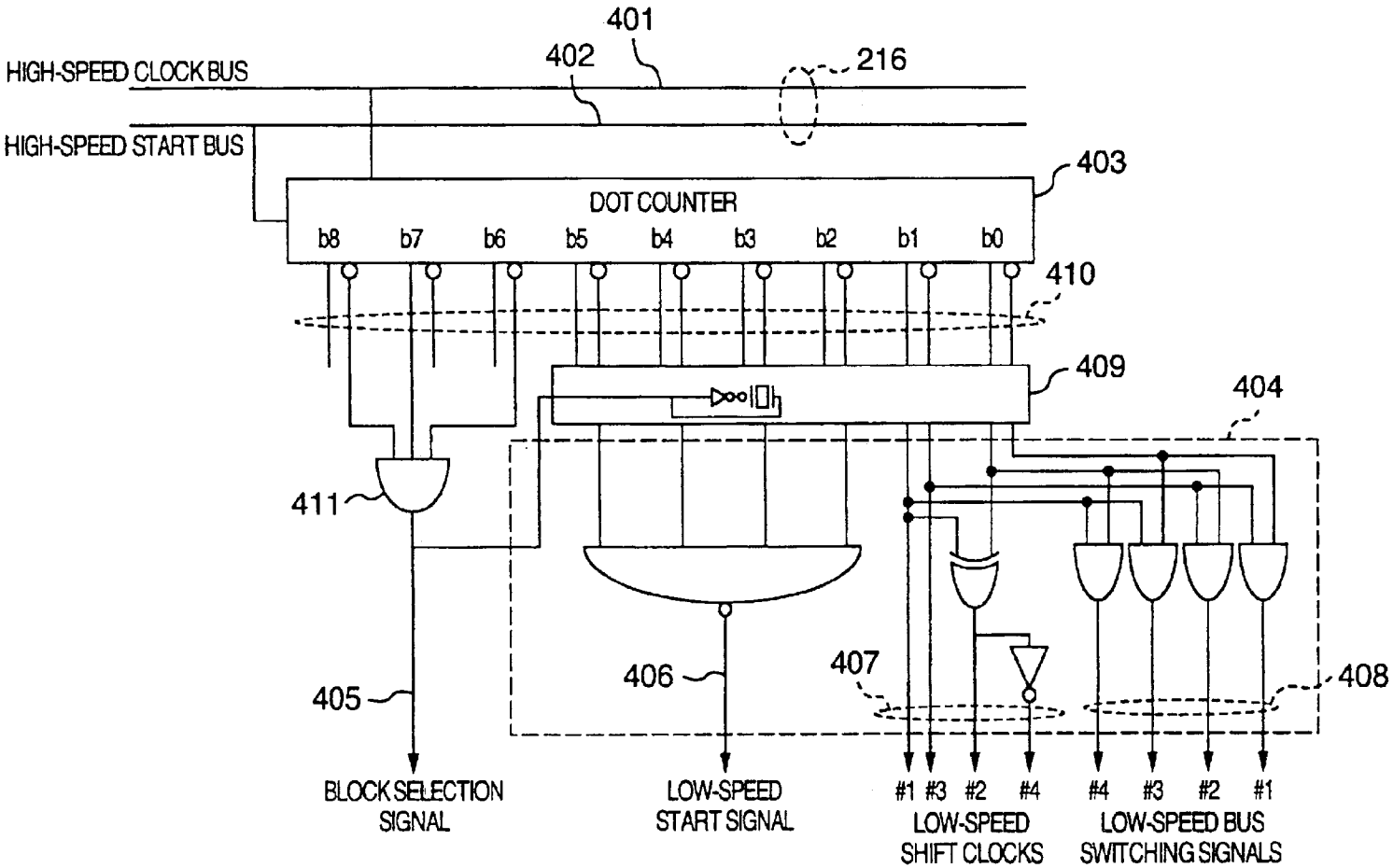
FIG. 5 is a detailed configuration diagram of the high-speed data rearranging circuit.

FIG. 4 and FIG. 5 illustrate the content configuration of the high-speed data rearranging circuit 101 and that of the high-speed data control circuit 104, both of which are the main components in the present invention. The high-speed control bus 216 includes a dot clock bus 401 and a horizontal start signal bus 402. The high-speed data control circuit 104 includes a dot counter 403 and a decoder circuit 404. Here, the dot counter 403 includes a 9-bit binary counter that, with the dot clock employed as a clock, operates with a rising edge of the horizontal start signal employed as a count start signal and with a falling edge thereof employed as a reset signal. Combination of b 8 to b 0, i.e., the respective bit outputs 410 of the dot counter 403, indicates a pixel position of the display data on respective scan the line that appears on the high-speed data bus not illustrated here. The decoder circuit 404 constituted using logical circuits generate the following necessary control signals from the bit outputs 410 of the dot counter 403.

A block selection signal 405 outputs an output of a logic "1" for a time-period during which the pixel data contained in the respective blocks are being outputted to the display data buses. In this case, it will do to decode b 8 to b 6, i.e., higher-order 3 bits of the counter outputs. It will do to set the states of the higher-order 3 bits to be as follows: (0 0 0) in the 1st block, (0 0 1) in the 2nd block, (0 1 1) in the 3rd block, and (1 1 1) in the 8th block. The block selection signal is "1" in a time-period corresponding to the case where the pixels of which the respective blocks are in charge are as follows: n=1 to 127 pixels in the 1st block at the left end of the screen, n=128 to 255 pixels in the 2nd block, and n=896 to 1024 pixels in the 8th block. In FIG. 4, because of being the 2nd block, the block selection signal is "1" when the states of the b 8 or b 6 is (0/0). The outputs b 5 to b 0 are provided with a switch 409. The switch 409 is controlled so that the following signals are outputted only when the block selection signal is "1". This prevents unnecessary operations of the logical circuits, thereby reducing the power consumption of the decoder circuit 404.

A low-speed start signal 406 is outputted for a time from a time-period when a pixel at the left end within the block to a 4-clock time-period. This signal is obtained by executing the NAND operation toward the case where all of b 5 to b 2 are 0.

4-phase low-speed shift clocks 407, i.e., # 1 to # 4, are generated using b 1 and b 0. Here, # 1 and # 3 are an inverted signal of b 1 and that of b 1, respectively, and # 2 is obtained by executing the EX-OR operation toward b 1 and b 0. As # 4, an inverted signal of # 2 is employed.

4 low-speed bus switching signals 408 can be generated by decoding b 0 and b 1. Incidentally, the dot counter 403 is reset for each horizontal period by the falling edge of the horizontal start pulse, and then the above-described operation is repeated for each line.

Next, the explanation will be given below using FIG. 4 concerning the detailed configuration of the high-speed data rearranging circuit 101 illustrated in FIG. 3, which is driven using the synchronization control signals for the respective blocks generated as mentioned above. A function of the high-speed data rearranging circuit 101 is to expand in n-parallel the signals on the high-speed data bus onto the low-speed data buses 102, the number of which is constituted to be n times that of the high-speed data bus 203. This function results in an advantage of prolong a display data processing time ranging from the data latch to the D/A converting processing for each pixel and of allowing the inputted display data to be dealt with at a high transfer rate even if the wiring response is slow. The explanation will be given here, letting n=4.

The respective wirings constituting the high-speed data bus 203 are connected to a bus driving circuit 502 through block selection switches 501, the electrical conductions of which are controlled in common on a block basis by the block selection signal 405. This causes the bus driving circuit to be connected to the high-speed data bus wirings as the load only when the block selection switches are brought into conduction states, or turned on by the block selection signal. As a result, it becomes possible to decrease the load capacitance of the high-speed data bus wirings and thus to make the data bus narrower. Outputs of the bus driving circuit have a function of switching the connection from a signal on 1 line of the high-speed data bus to a signal on 4 lines of the low-speed data buses. The bus driving circuit is of a selector circuit configuration constituted by 4 units of CMOS analogue switches, and is connected to low-speed bus switching switches 503 controlled by the low-speed bus switching signals. In this case, there exist 4 lines of the low-speed data buses toward 1 line of the high-speed data bus. Accordingly, in order to achieve the 6-bit gray shade display for each pixel, it is necessary to use 6×4 lines=24 lines of the low-speed data buses. Also, the large numbers of data latch circuits and parastic capacitors 504, which are formed by intersection portions of the wirings, are formed on the low-speed data buses. This condition allows the voltages of the low-speed data bus wirings to be maintained even when the low-speed bus switching switches are cut off. Incidentally, the block selection switches 501 and the low-speed bus switching switches 503 can be implemented by the combination of appropriate logical circuits having the other similar functions.

Figure 6:
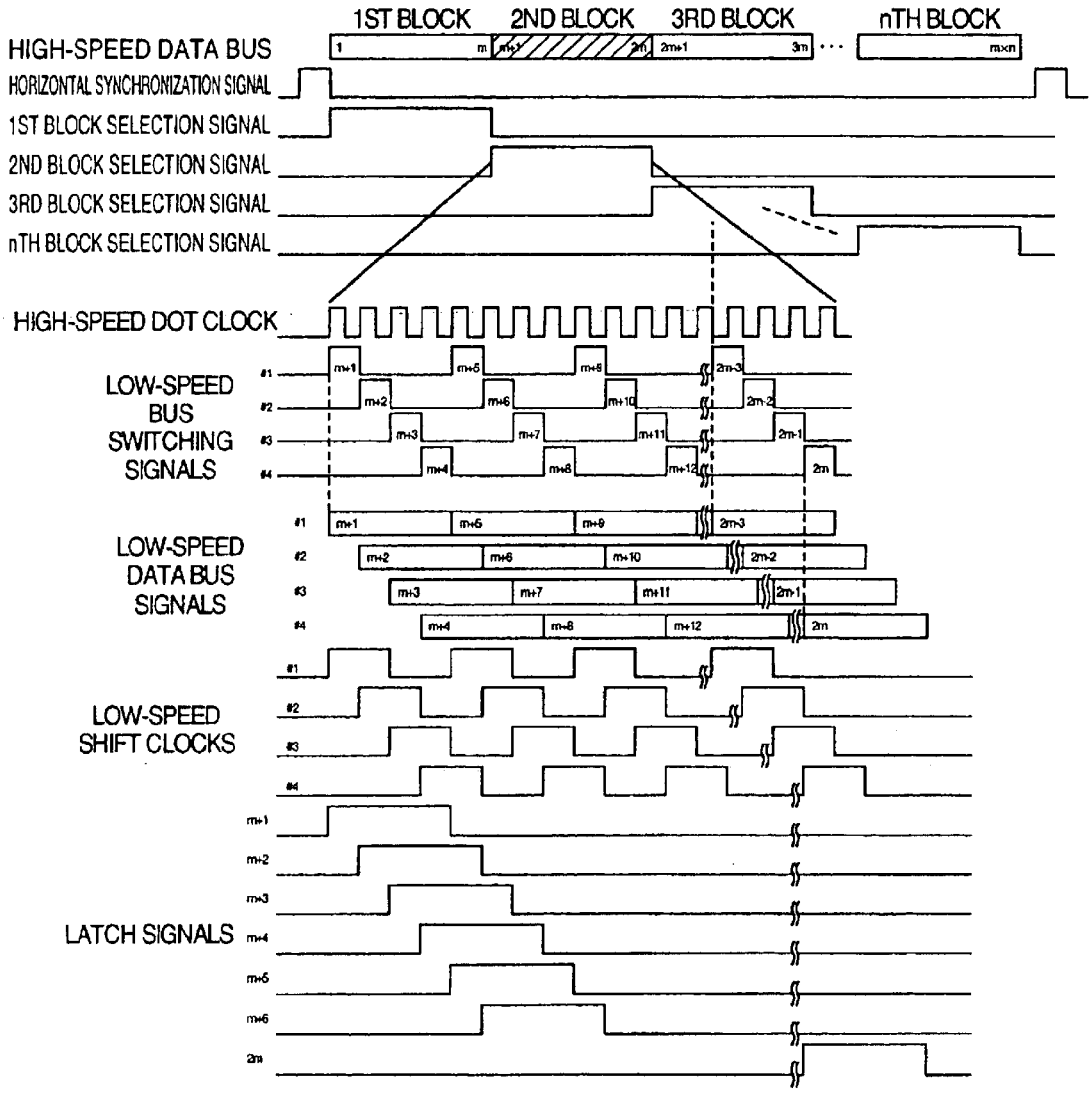
FIG. 6 is an explanatory diagram for explaining operation waveforms in the respective portions of the high-speed data rearranging circuit.

Next, the explanation will be given below regarding the circuit operation by using the waveforms. FIG. 6 illustrates the operation waveforms in the respective portions of the high-speed data control circuit 104 and the high-speed data rearranging circuit 101, which execute the signal converting processing from the high-speed data bus to the low-speed data buses. Here, there is presented the case where there exist n units of blocks, each of which includes m pixels and 4 lines of the low-speed data buses per bit within each block. On the high-speed data bus, there appear in sequence the display data from 1 to (m×n) pixels, i.e., the pixels by the amount of one scan line, in synchronization with the horizontal synchronization signal with positive polarity. The block selection signal in the respective blocks becomes a positive logic for only a time-period during which the data equivalent to the respective blocks appear, thereby turning on the block selection switches 405 into the conduction states so as to connect the high-speed data bus 203 to the bus driving circuit 502. Hereinafter, the operation of the high-speed data rearranging circuit 101 will be explained concerning the 2nd block including (m+1) to 2m pixels. For a time-period during which the data corresponding to the pixels within the 2nd block are being supplied, the high-speed data rearranging circuit 101 is caused to synchronize the high-speed dot clock by the high-speed data control circuit 104. Thus, 4 units of the low-speed bus switching signals # 1 to # 4 are generated, the period of the switching signals being equal to 4 periods of the high-speed dot clock and the phases thereof being delayed to each other by 1 clock. In accordance with the low-speed bus switching signals, the low-speed bus switching switches 503 connect the respective bits onto 4 lines of the low-speed data buses. As a result, the data at 4-pixel intervals are fetched onto the low-speed data buses in such a manner that the data in (m+1) and (m+5) pixels are fetched onto the bus of # 1 and the data in (m+2) and (m+6) pixels are fetched onto the bus of # 2. Consequently, the data on the low-speed data buses are updated every 4 pixels in the following sequence: the data in (m+1) pixel on # 1, the data in (m+2) pixel on # 2, the data in (m+3) pixel on # 3, the data in (m+4) pixel on # 4, the data in (m+5) pixel on # 1, and the data in (m+6) pixel on # 2. In this way, the serial data in the 1-pixel sequence, which have been transferred by 1 line of the high-speed data bus, are distributed on the low-speed data buses in the parallel form at 4-pixel intervals.

In order to fetch the data into the data latches 302 illustrated in FIG. 3, 4-phase shift registers are employed as the shift registers 301 within the respective blocks. 4-phase clocks for driving the 4-phase shift registers are generated as the low-speed shift clocks by the high-speed data control circuit 104. The period of the low-speed shift clocks is equal to 4 periods of the high-speed dot clock and the phases thereof are delayed to each other by 1 clock, as is the case with the low-speed bus switching signals. Outputs of the respective stages of the shift registers become latch signals for driving the data latches 302 in FIG. 3. The latch signals have become pulses, the pulse width of which is equal to 4 periods of the high-speed dot clock and which are delayed to each other by 1 clock.

Figure 7:
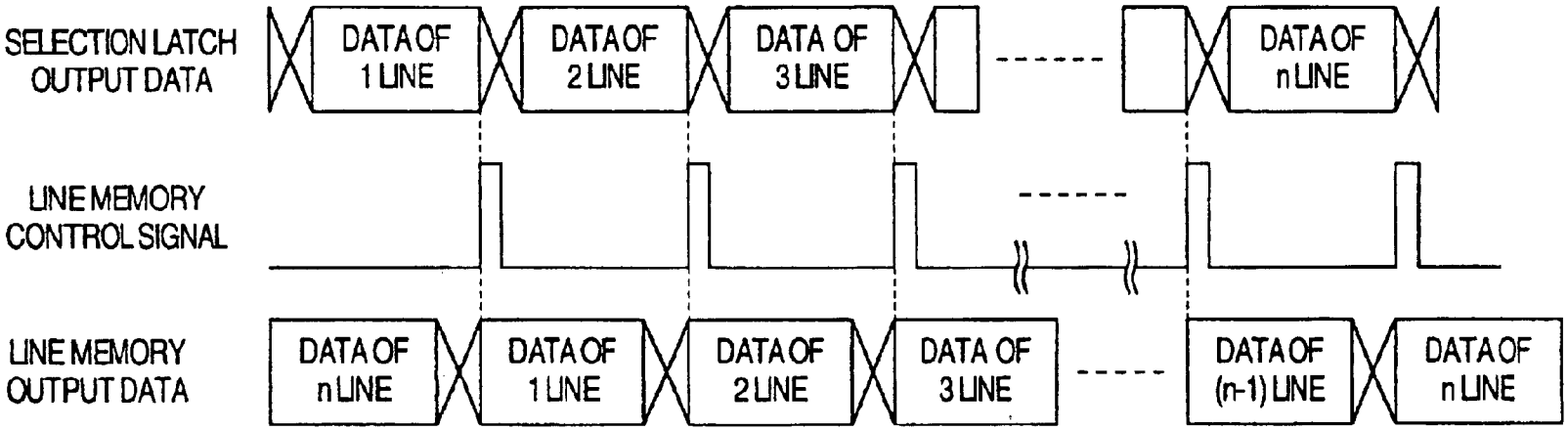
FIG. 7 is an explanatory diagram for explaining the operation of the line memory.
Figure 8:
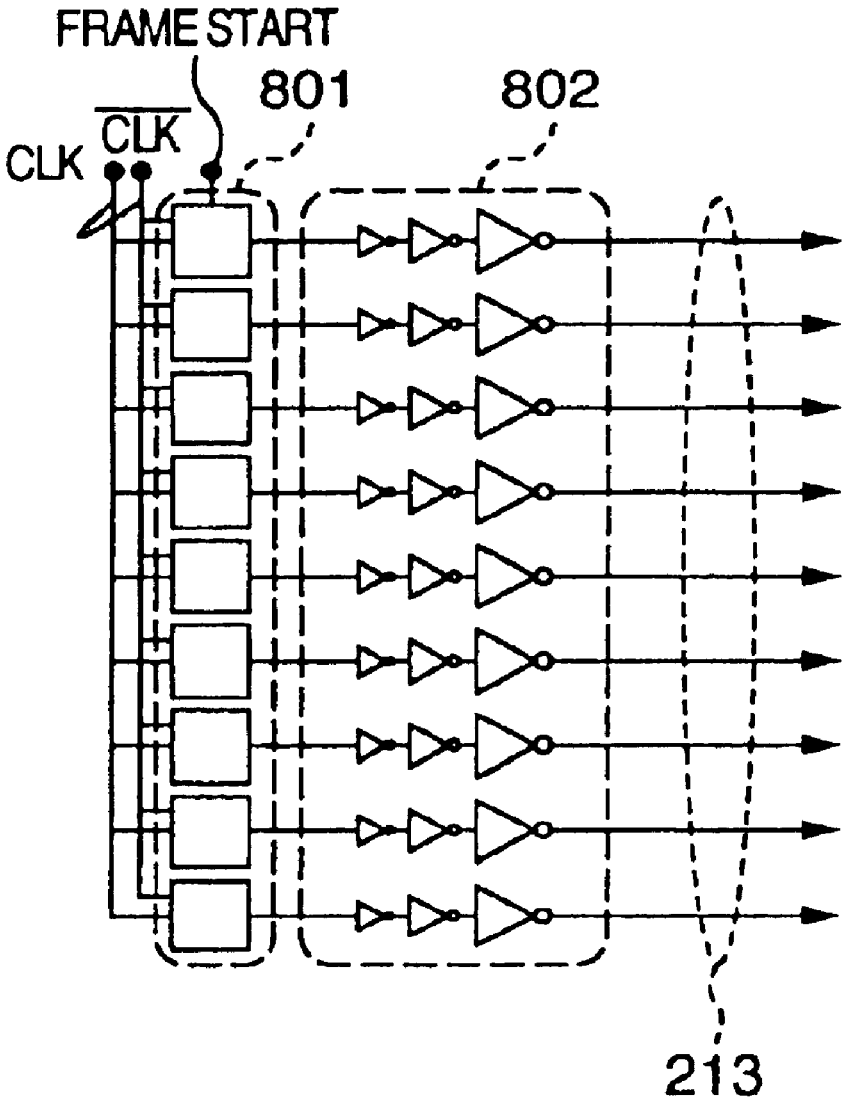
FIG. 8 is a detailed configuration diagram of the scanning circuit.

Next, referring to FIG. 7, the explanation will be given below concerning the respective line memories. The respective data latches are connected to outputs of the respective line memories, and the data by the amount of one scanning line are updated for each horizontal time-period. In accordance with a line memory control signal, the line memories fetch the data to be inputted after being updated, then updating the data. The updated data are connected to the respective D/A converting circuits 207 in FIG. 3 and are converted into the liquid crystal driving voltage instantaneously, then being supplied to the signal lines 208 for driving the pixel unit 209. The operation waveforms of the pixel unit are the same as those in conventional configuration, and accordingly will be explained briefly. A configuration of a circuit is illustrated in FIG. 8 in which the circuit is connected to the scanning lines 213 for one line. The shift registers 801 drive the circuit, taking advantage of the shift clock with a period of one horizontal time-period and a pulse of the frame start signal for each frame time. The circuit applies scanning pulses, which are shifted in sequence for each period of one horizontal time-period, to the scanning lines 213 in FIG. 3 through the level shifters and the data driver circuit 802. Also, in the data driver circuit 307 in FIG. 3 the D/A converting circuits apply the liquid crystal driving voltage in each dot to the respective signal wirings by the amount of one line in synchronization with the scanning pulses, thereby performing the display by the pixels.

Figure 9:
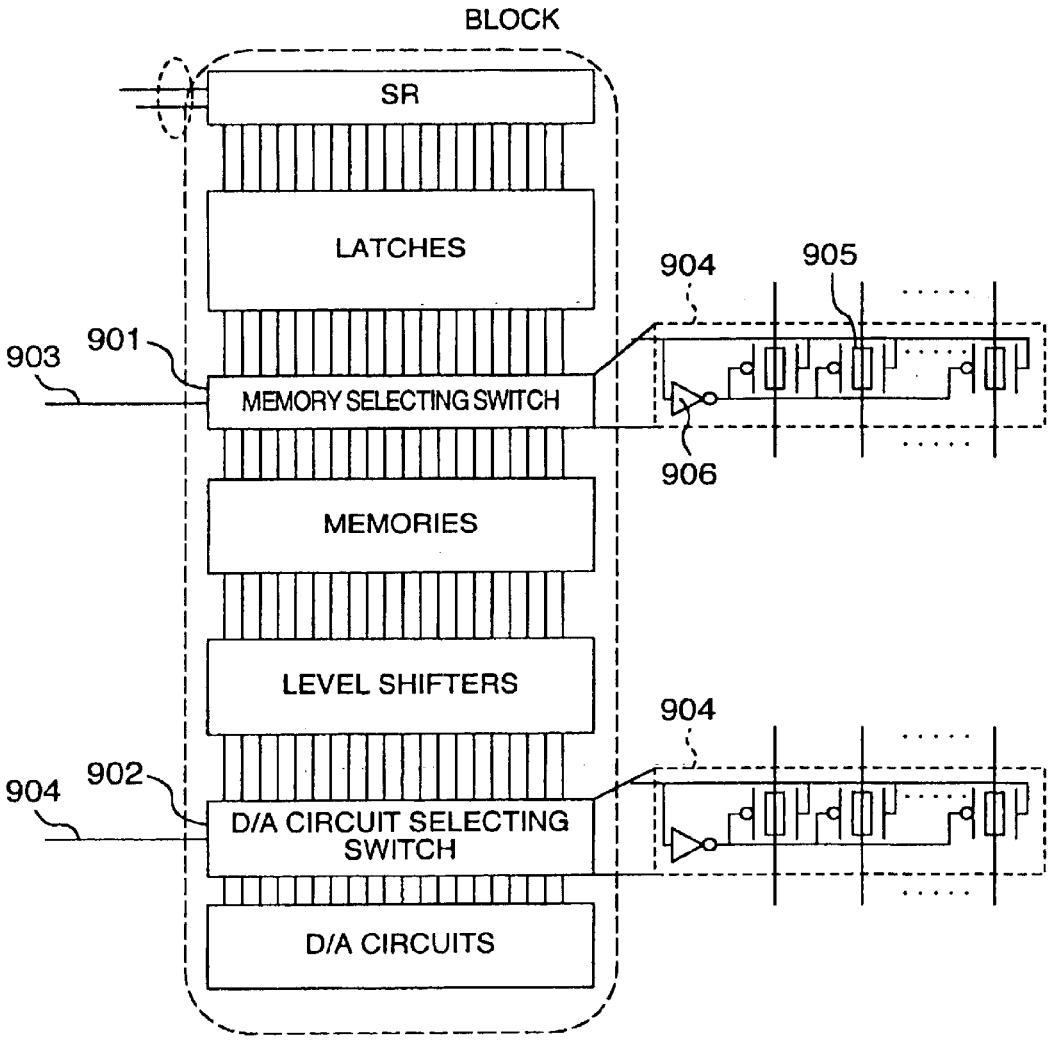
FIG. 9 is a configuration diagram of a second embodiment of the present invention.

Next, referring to FIG. 9, the explanation will be given below regarding a second embodiment of the present invention. The diagram illustrates the circuit configuration of each block. A characteristic of the system lies in a point of transferring the latches from the data latches to the memories with timings that are different for the respective blocks. Also, another characteristic lies in a point of performing the data transfer from the line memories to the D/A converting circuits with timings that are different for the respective blocks. For the purpose of implementing these characteristics, the embodiment is configured as follows: A memory selecting switch 901 is provided between the latch circuits and the memory circuits and a D/A converting circuit selecting switch 902 is provided between the line memories and the D/A converting circuits, and the switch 901 and the switch 902 are controlled by a memory transferring signal 903 and a D/A conversion transferring signal 904, respectively. The memory selecting switch and the D/A selecting switch are configured by employing CMOS analogue switches 905 by the number of the lines, and in addition inverters 906 are employed in order to obtain control signals with both polarities for driving the analogue switches. The control signals for driving the analogue switches are connected in common, thereby collectively controlling the analogue switches by the number of one block with the use of the respective transferring signals 903, 904. This configuration allows the operations of the line memory circuits to be dispersed for each block, thus resulting in an advantage of being able to disperse the power consumption and decrease the capacitance of the power supply circuit. Also, the D/A converting circuits are driven in a state of being divided for each block, thereby making it possible to disperse in time the power supply current of the D/A converting circuits. This results in an advantage of being able not only to reduce the power consumption but also to obtain a liquid crystal driving voltage that is stable and exhibits a less error even if the wiring resistance is high. The reason for the latter is that it is possible to reduce a voltage drop in the power supply wiring.

According to the present invention, the high-speed data buses and the high-speed control buses formed on the display TFT substrate supply the synchronization signals, such as the high-speed display data and the dot clock both of which are supplied from the outside, to the terminal end of the data driver circuit through the waveform shaping circuits.

The display data are distributed in parallel onto the large numbers of low-speed data buses separated for each block, then being fetched at a low transfer rate into the respective data latches within each block. After that, by being transferred to the respective line memories, the display data by the amount of one line are latched therein. Taking advantage of the data, the digital gray shade data in each dot are converted into the gray shade voltage to be applied to the liquid crystal of the pixels.

Transferring the display data to the large numbers of the data latches in this way permits the display data to be transferred as a whole to the peripheral circuit on the large-sized panel at a high transfer rate, thus making it possible to easily configure the large-sized high-resolution panel.

The liquid crystal display apparatus according to the present invention exhibits only a small load capacitance on the display panel, and even in the large-sized high-resolution panel, allows the display data inputted into the high-speed data buses to be transmitted up to the terminal ends of the data buses with a small waveform distortion.

What is claimed is:

1. A liquid crystal display apparatus comprising:

a pair of substrates, at least one substrate being transparent;

a liquid crystal layer sandwiched between the pair of substrates, wherein the one substrate of the pair of substrates includes a plurality of scanning wirings, a plurality of signal wirings, a plurality of thin film semiconductor devices formed in correspondence with intersections of the scanning wirings and the signal wirings, and a display electrode connected to the plurality of semiconductor devices, and wherein another substrate of the pair of substrates includes an opposed electrode;

first buses extended continuously over a width of signal wirings, and second buses dividing the width of the signal wirings into a plurality of blocks, as buses for transferring display data to the signal wirings formed on the one substrate, a number of the signal wirings of the second buses being greater than that of the signal wirings of the first buses;

a circuit formed between the first and second buses for each of the plurality of blocks, which transfers display data from the first buses to the second buses;

a data latch circuit which reads the display data in sequence through the second buses to latch the display data of one block amount;

a memory circuit which reads out the display data of the one block amount simultaneously;

a level shifter circuit which reads out a content of the memory circuit to change a logical voltage of the content;

a D/A circuit which converts an output from the level shifter circuit into an analog voltage to drive the signal wirings; and a waveform shaping circuit provided on the first buses between the plurality of blocks, for shaping digital waveform.

2. A liquid crystal display apparatus according to claim 1, wherein the waveform shaping circuit is configured by connecting in series an even number of inverter circuits.

3. A liquid crystal display apparatus comprising:

a pair of substrates, at least one substrate of the pair of substrates being transparent;

a liquid crystal layer sandwiched between the pair of substrates, wherein the one substrate of the pair of substrates includes a plurality of scanning wirings, a plurality of signal wirings, a plurality of thin film semiconductor devices formed in correspondence with intersections of the scanning wirings and the signal wirings, and a display electrode connected to the plurality of semiconductor devices, and wherein another substrate of the pair of substrates includes an opposed electrode;

first buses extended continuously over a width of the signal wirings, for transferring data to the signal wirings formed on the one substrate of the pair of substrate;

second buses divided the width of signal wirings into a plurality of blocks, for transferring data to the signal wirings formed on the one substrate of the pair of substrates, a number of the signal wirings of the second buses being greater than that of the signal wirings of the first buses;

a circuit formed between the first buses and the second buses for each of the blocks, for rearranging data from the first buses and distributing the data in parallel onto the second buses;

a data latch circuit arranged within each block to read the data in sequence through the second buses to latch the data of one block amount;

a memory circuit arranged within each block to read out the data of the one block amount simultaneously;

a level shifter circuit arranged within each block to read out a content of the memory circuit to change a logical voltage of the content; and a D/A circuit arranged within each block to convert an output from the level shifter circuit into an analog voltage to drive the signal wirings.

4. A liquid crystal display apparatus according to claim 3, wherein the circuit between the first and second buses converts display data on the first buses from serial into parallel data for distribution onto the second buses.

5. A liquid crystal display apparatus according to claim 4, wherein the circuit between the first and second buses includes a plurality of switches with transistors, each switch selectively connecting to one of the first buses and plural second buses to switch the signal wirings of the second buses to be connected by a time-division manner in synchronism with the data on the first buses.

6. A liquid crystal display apparatus according to claim 3, further comprising at least one waveform shaping circuit provided on the first buses, and arranged between the plurality of blocks, for shaping digital waveform.

7. A liquid crystal display apparatus according to claim 3, further comprising at least a waveform shaping circuit provided on the first buses, and arranged between the plurality of blocks, for correcting a timing displacement between a waveform distortion caused by transferring display data on the first buses.

8. A liquid crystal display apparatus according to claim 3, further comprising a switch provided between the first buses, and a controller which distributes the display data on the first buses in parallel onto the second buses by a time-division manner, the switch being controlled to be turned on where data on the signal wirings included in the block is only transferred.

9. A liquid crystal display apparatus according to claim 3, further comprising a memory selection switch for blocking data transfer on the signal wirings connected between the data latch circuit and the memory circuit, and for controlling to transfer the display data in a different timing for each of the blocks.

* * * * *